United States Patent [19]

Krieger et al.

[11] Patent Number: 4,605,393

[45] Date of Patent: Aug. 12, 1986

[54] CARTON BLANK REMOVAL, ERECTION AND TRANSFER APPARATUS

[75] Inventors: Eberhard Krieger, Weinstadt; Theo Moser, Steinenberg, both of Fed. Rep. of Germany

[73] Assignee: Robert Bosch GmbH, Stuttgart, Fed. Rep. of Germany

[21] Appl. No.: 695,111

[22] Filed: Jan. 25, 1985

[30] Foreign Application Priority Data

Apr. 7, 1984 [DE] Fed. Rep. of Germany ..... 3413232

[51] Int. Cl.[4] ..... B31B 3/80

[52] U.S. Cl. ..... 493/317; 271/95

[58] Field of Search ..... 493/125, 315, 316, 317, 493/123; 271/91, 95, 99

[56] References Cited

U.S. PATENT DOCUMENTS

| | | | |
|---|---|---|---|
| 3,718,328 | 2/1973 | Comstock | 271/20 |
| 3,937,458 | 2/1976 | Langen | 271/95 |
| 3,956,976 | 5/1976 | Vogel et al. | 493/315 |
| 4,081,945 | 4/1978 | Calvert et al. | 53/186 |
| 4,194,442 | 3/1980 | Martelli | 493/316 |
| 4,211,153 | 7/1980 | Walters et al. | 493/310 |
| 4,232,591 | 11/1980 | Karpinsky | 493/314 |
| 4,518,301 | 5/1985 | Greenwell | 414/129 |
| 4,531,931 | 7/1985 | Dietrich | 493/317 |
| 4,537,587 | 8/1985 | Langen | 493/315 |

*Primary Examiner*—Francis S. Husar
*Assistant Examiner*—William E. Terrell
*Attorney, Agent, or Firm*—Edwin E. Greigg

[57] ABSTRACT

An apparatus for removing carton blanks, erecting and transferring cartons to a conveyor apparatus which includes a magazine for cartons and a rotor with a plurality of radially offstanding suction units. To attain a high output with an apparatus which is simple in structure, the rotor is disposed on a pivotable arm. On each pivoting movement of the rotor during one operating cycle, a carton blank is removed from the magazine while simultaneously formed carton is inserted into the conveyor apparatus at a transfer station. A counterpart suction device, which is associated with a station between the magazine and the transfer station, erects the cartons and breaks them on themselves.

7 Claims, 2 Drawing Figures

CARTON BLANK REMOVAL, ERECTION AND TRANSFER APPARATUS

BACKGROUND OF THE INVENTION

The invention is based on an apparatus for removing, erecting and transferring carton blanks as defined hereinafter. An apparatus of this type is already known from U.S. Pat. No. 4,211,153, in which, however, the rotor rotates about a stationary axis. In order to remove carton blanks from the magazine and deposit them in a conveyor apparatus, the suction devices are secured on radially movable support bars guided in slots of the rotor. A complicated mechanism having a pawl controls a relative movement between the rotor and the support bars during each incremental rotation of the rotor, thereby radially adjusting the support bars.

OBJECT AND SUMMARY OF THE INVENTION

The apparatus according to the invention for removing, erecting and transferring carton blanks has the advantage over the prior art that its structure is relatively simple and that with it, a very high output is attainable. Furthermore, the magazine can be disposed in front of the conveyor apparatus for the erected cartons, so that the conveyor path of the conveyor apparatus is freely accessible from above.

In a particularly advantageous embodiment of the invention, the pivoting shaft of the arm is disposed in an area between the removal end of the magazine and the transfer station at the conveyor apparatus, the magazine being disposed in front of the conveyor apparatus.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
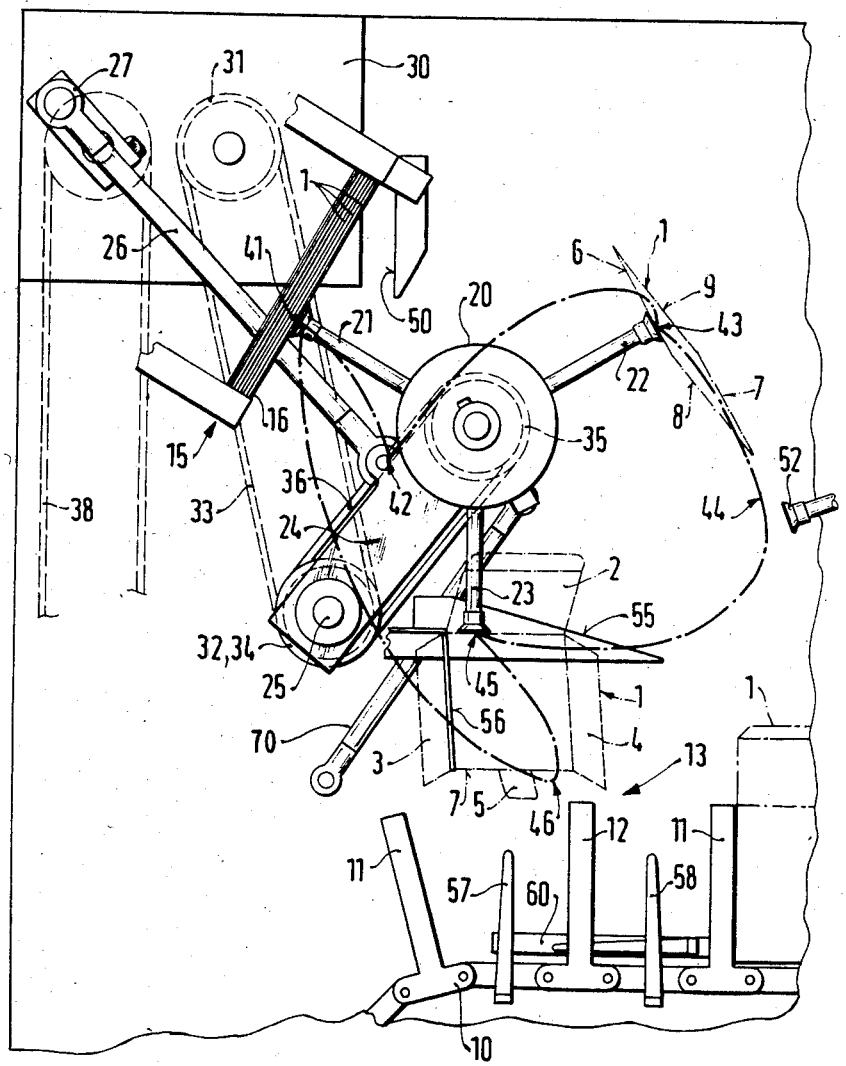
FIG. 1 is a side view of an apparatus for removing, erecting and transferring carton blanks in a first position.

A carton forming machine, not shown, has a conveyor chain 10 with pairs of drivers 11, 12, which convey formed cartons 1 in a horizontal conveyor path to various processing stations. The indexed conveyor chain 10 travels over a deflecting section and enters the horizontal conveyor path, at the beginning of which a transfer station 13 for the cartons is disposed. A magazine 15 for the carton blanks 1, which lie flat, is located above the conveyor path of the conveyor chain 10 and in front of the transfer station 13 in the conveying direction. The magazine 15 is inclined at a shallow angle relative to the conveyor path of the conveyor chain 10.

The apparatus for removal, erection and transfer of the carton blanks 1 is disposed between the removal end 16 of the magazine and the transfer station 13. The apparatus has a rotor 20 with three equally spaced radially offstanding suction devices 21, 22, 23 spaced apart by identical angular intervals. The rotor 20 is moved clockwise in increments of 120° at a time, and is rotatably supported on a pivotable arm 24, which pivots on a pivoting shaft 25 which is located below the removal end 16 of the magazine 15. The pivot arm 24 is joined to a coupler 26 which is secured at one end to a crank 27 rotatable by a drive wheel, not shown. As the crank 27 rotates, the rotor 20 is pivoted back and forth on a circular arc between the removal end 16 of the magazine 15 and the transfer station 13.

The rotor 20 is rotated clockwise in increments of 120° via two belt drives, one of which has a driving wheel 31 on a gear mechanism 30, a driven wheel 32 on the pivoting shaft 25 and a toothed belt 33, while the other belt drive has a driving wheel 34 joined to the driven wheel 32, a driven wheel 35 joined to the rotor 20 and a toothed belt 36.

The gear mechanism 30, which is driven by the packaging machine via a toothed belt drive 38, sets the crank 27 into uniform rotation, so that the crank 27 executes one rotation per incremental movement of the conveyor chain 10. The gear mechanism drives the rotor 20 incrementally, so that the interval between rotations of the crank substantially coincides with the pivoting movement of the rotor 20 from the removal end 16 of the magazine 15 toward the transfer station 13. Because of these drive means, the suction devices 21, 22, 23 move along a closed path, one defined by a plurality of arcs, as shown in dot-dash lines in FIG. 1. Beginning at a position in which one suction device 21 is located at the removal end 16 of the magazine 15, the suction device 21 moves from a point 41 during the interval in rotations of the crank 27 and the rotor 20 by pivoting the arm 24 from the top dead center to the bottom dead center on a circular arc to a point 42, thereby removing one carton blank 1 from the magazine 15. While the arm 24 now pivots back from bottom dead center to top dead center by the crank 27 and coupler arm 26, a rotating movement by 120° is superimposed on the pivoting movement of the rotor 20, so that the suction device 21 moves on an arc from point 42 to a point 43. During this cycle of operation, the second suction device 22 moves from point 43 to a point 44 in the vicinity of the transfer station 13. Furthermore, during this same cycle, the third suction device 23 moves on an arc to a lower point 46 and from there over a relatively flat, long arc back to point 41 at the magazine 15. The arc shape of the path of the suction devices 21, 22, 23 from one of the points 41 to 46 is furthermore influenced by the fact that when the arm 24 pivots, a rotational movement is generated by crank 27 which is superimposed on the drive by the gear mechanism 30.

Figure 2:
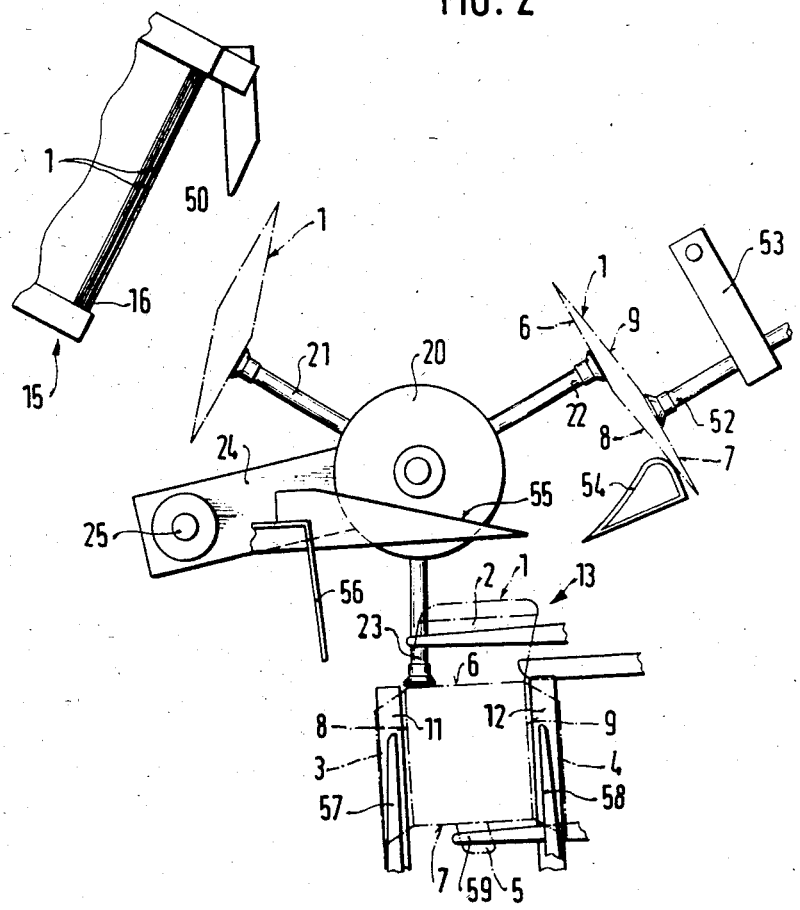
FIG. 2 is a side view of the apparatus of FIG. 1 in a second position.

As the suction devices 21, 22, 23 travel over the above-described course, the suction device 21, in the vicinity of the point 41, grasps the frontmost flat carton blank 1 in the magazine 15 and pulls it away from the removal end 16 of the magazine 15, whereupon the upper edge of the carton blank 1 strikes against a stop face 50, where it is somewhat restrained, so that the carton blank 1 opens partially (FIG. 2). By means of a rotational movement of the rotor 20, this carton 1 is then moved to a position in which the suction device 21 is located at point 43 to partially open the blank. During this cycle of operation, the carton blank 1 which had previously been removed from the magazine 15 by the suction device 22 is moved from point 43 to point 44 during the pivoting movement of the arm 24; from there, during the rotational movement of the rotor 20 and the return stroke of the arm 24, the partially opened carton 1 is moved to point 45 in the transfer station 13. When the suction device 22 enters point 44, a counterpart suction device 52 moves on a lever 53 toward the wall 7 of the carton partially open 1 which is located opposite the wall 6 engaged by the suction device 22. While the suction device 22 thereupon moves from point 44 to point 45 and the counterpart suction device 52 pivots back, the partially open carton 1 that has been grasped is opened and bent on itself, thereby eliminating the strains in the edges to such an extent that the carton 1 assumes a rectangular cross section. This action of erecting and bending the cartons 1 can be reinforced, or even executed automatically, by a fixed stop deflector 54 in the conveyor path of the partially open cartons 1. As the suction device 22 enters point 45, a top flap 2 protruding from the carton 1 is bent upward by a fixed deflector 55. Finally, with its wall 8 located forwardmost in the conveying direction, the carton strikes against a stop plate 56, so that it substantially retains its rectangular cross section. During the same operating cycle, during the pivoting movement of the arm 24 from the upper position into the lower position, the suction device 23 presses the formed cartons 1 obliquely downward along an arc between the points 45 and 46, to between two drivers 11, 12 of the conveyor chain 10. This portion of the movement of the suction device 23 with a carton 1, serving to introduce the carton between two drivers 11, 12 of the conveyor chain 10, includes a vertical and a horizontal component. The horizontal component corresponds to the horizontal entering movement of the drivers 11, 12 of the conveyor chain 10 upon entry into the transfer station 13, so that the side walls 8, 9 of the cartons 1 are introduced without impact between the drivers 11, 12, which as they enter the transfer station 13 are partially spread open. Also associated with the transfer station 13 are two vertical fingers 57, 58. Side flaps 3, 4 protruding from the side walls of the cartons 1 are bent outward by these fingers 57, 58 (FIG. 2). Shortly before the arm 24 reaches its bottom dead center position, the negative pressure at the suction device 23 is switched off by use of an arm 70 that controls a valve to the negative pressure, so that the carton 1 which has been inserted between the drivers 11, 12 is freed from the suction device 23. Subsequently the suction device 23 returns from point 46 to point 41 at the removal end 16 of the magazine 15, during one incremental movement of the rotor 20 and during the return movement of the arm 24. The removal, erection and transfer of cartons 1 is repeated in this manner during each operating cycle of the apparatus therefor and of the conveyor apparatus of the cartoning machine.

Because the rotor 20 rotates counter to the conveying direction of the conveyor apparatus 10 in the vicinity of the transfer station 13, the magazine 15 can be disposed in front of the conveyor apparatus 10, where it does not cover the conveyor apparatus 10.

The opened cartons 1 each introduced between two drivers 11, 12 of the conveyor chain 10 in the transfer station 13 rest with their bottom wall 7 on horizontal rails 60 and slide on it during the time they are conveyed by the drivers 11, 12. For cartons 1 in which a safety flap 5 protrudes from the bottom wall, a horizontal deflector 59 is disposed at the level of the rails 60, bending the safety flap 5 downward.

The negative pressure for the suction devices 21, 22, 23 is controlled by a rotary slide valve known per se, not shown but disposed coaxially with the rotor 20, such that for grasping a carton 1 in the magazine 15 a negative pressure is supplied to the respective suction device 21, 22, 23 and maintained until such time as the particular carton 1 has been inserted between two drivers 11, 12 at the transfer station 13.

It should also be noted that for processing relatively large cartons, a plurality of suction devices combined into a unit may be disposed on the rotor 20, instead of only a single suction device.

Furthermore, instead of three suction units, it is also possible for only two, or more than three, suction devices to be disposed on the rotor 20, in which case the angle of incremental rotation of the rotor 20 is adapted accordingly. Disposing more than two suction units has the advantage that one or more intermediate stations are then available for the disposition of devices for handling the cartons, for instance for breaking or folding the edges, or for automatically opening, marking, or gluing the cartons, and the like.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An apparatus for removing carton blanks, erecting and transferring cartons which comprises:

means comprising a conveyor apparatus, for moving said cartons in a conveying direction, a magazine disposed forward of and above one end of said conveyor, a rotor which is disposed between said magazine and a transfer station of said conveyor apparatus, means operatively connected to said rotor for rotating said rotor in increments of a predetermined angle, said rotor having means comprising three equally spaced suction units disposed on said rotor in a radially offstanding fashion for grasping a second wall of said carton blank, means comprising a valve device for connecting each of said three suction units intermittently to a source of negative pressure, said rotor being supported on an arm, said arm being pivotable about a shaft disposed in an area between a carton blank removal end of the magazine and the transfer station of said conveyor apparatus, means operatively connected to said arm for pivoting said arm and said rotor away from said magazine substantially during an interval between rotations of said rotor, means comprising a counterpart suction device disposed in a vicinity of the transfer station for temporarily grasping a first wall of a partially open carton located opposite said second wall grasped by a suction unit of said rotor, said rotating means and said pivoting means being synchronized so that in the vicinity of the transfer station the rotor has a rotational movement contrary to the conveying direction of the conveyor apparatus, which moves in a direction away from the magazine.

2. An apparatus as defined by claim 1, in which said counterpart suction device is pivotably disposed.

3. An apparatus as defined by claim 2, in which said arm is joined via a coupler to a crank.

4. An apparatus as defined by claim 2, in which said rotor is driven via an endless drive means which is guided via a drive wheel coaxial with said pivoting shaft of said arm and via a driven wheel coaxial with the axis of rotation of said rotor.

5. An apparatus as defined by claim 1, in which a stop for one wall of a partially open carton is located in front of a wall of said partially open carton in a direction of rotation of said rotor and is disposed in said transfer station above a movement path of a pair of drivers on said conveyor apparatus.

6. An apparatus as defined by claim 5, in which said arm is joined via a coupler to a crank.

7. An apparatus as defined by claim 5, in which said rotor is driven via an endless drive means which is guided via a drive wheel coaxial with said pivoting shaft of said arm and via a driven wheel coaxial with the axis of rotation of said rotor.

* * * * *